United States Patent [19]

Scholle et al.

[11] Patent Number: 4,924,791

[45] Date of Patent: May 15, 1990

[54] ADJUSTABLE SAILBOARD

[76] Inventors: Roger A. Scholle, 8 White Birch La., Scarsdale, N.Y. 10583; Stephen R. Scholle, 5 Homewood Rd., Hartsdale, N.Y. 10530

[21] Appl. No.: 294,389

[22] Filed: Jan. 6, 1989

[51] Int. Cl.[5] ..... B63B 41/00

[52] U.S. Cl. ..... 114/39.2; 114/153; 114/162; 114/165; 114/363; 114/344

[58] Field of Search ..... 114/144 R, 153, 152, 114/162, 165, 343, 363, 39.1, 39.2, 344, 127, 132, 169, 135–137; 441/65, 74

[56] References Cited

U.S. PATENT DOCUMENTS

| | | | |
|---|---|---|---|
| 427,845 | 5/1890 | Garcia-Sanchez | 114/162 |
| 1,661,499 | 3/1928 | Proteau | 440/31 |
| 1,986,750 | 1/1935 | Ring | 440/31 |
| 3,793,973 | 2/1974 | Patterson | 114/39 |
| 3,902,441 | 9/1975 | Scholle | 114/39 |

FOREIGN PATENT DOCUMENTS

| | | | |
|---|---|---|---|
| 650922 | 10/1937 | Fed. Rep. of Germany | 114/153 |

*Primary Examiner*—Sherman D. Basinger
*Assistant Examiner*—Clifford T. Bartz

[57] ABSTRACT

A sailboard including hull, mast and rigged sail assembly and a foot operated rudder pivotally and rotatably mounted to the stern of the hull, with the rudder being adjustable longitudinally to the different heights of sailboard users while maintaining the same or desired craft displacement of the sailboard regardless of the body and/or leg lengths of any user.

20 Claims, 6 Drawing Sheets

ADJUSTABLE SAILBOARD

FIELD OF THE INVENTION

The present invention relates to an improved sailboard and more particularly, it relates to an adjustable foot-operated rudder for steering a sailboard from a prone position.

BACKGROUND OF THE INVENTION

As is well known in the art, sailboards are generally steered using a hand-operated tiller while sitting on the deck, such as in a Sunfish, Sailfish, or other types of sailboats. Alternately, others such as conventional sailboards, are steered from a standing position using the arms to alter the angle of the mast and boom relative to the sailboard and the prevailing wind. Another method of steering a sailboard is to lie prone on the deck, belly-down with the head pointing toward the bow and the feet protruding past the stern, as can be seen from U.S. Pat. No. 3,902,441, granted to Roger A. Scholle on Sep. 2, 1975. Another patent which discloses a sailing craft operated by a person lying prone on the hull is shown and described in U.S. Pat. No. 3,793,973, granted Feb. 26, 1974 to George W. Patterson. The feet can then operate a rudder device by pressing against a cross bar. The left foot can press against the left half of the cross bar to steer the boat to the right and the right foot can press against the right half of the cross bar to steer the boat to the left. The advantages of this kind of steering mechanism are as follows: it allows for a smaller, more portable sailing craft than a conventional sailboat, which involves a cockpit, or than a Sailfish, which requires a larger hull for stability while sitting. It also provides certain advantages over a Windsurfer-type sailboard that requires standing because the sailboard requires learning a very difficult and unconventional method of sailing. Standing sailboarding is very much unlike sailing and is exceedingly difficult to learn because it requires athleticism, arm strength, agility and balance, as well as a skill of steering and operation which is very much different from conventional sailboating. Unlike the standing sailboard, a sailboard operated from a prone position is operated in the conventional manner of single-sail sailboats, using a mainsheet and a rudder. It is thus easy to adapt to for persons with even a minimum of sailing experience. Furthermore, it does not require the athleticism and agility of a standup-operated sailboard.

Important to a sailboard operated from a prone position is the foot-operated rudder, as such rudder allows the sailboard to be used from a prone position since from such a position the feet can efficiently operate the rudder. In addition, such a configuration allows one hand to control the mainsheet while the other is free to grasp the gunwhale or otherwise help in balancing. In addition, under adversely rough or calm conditions, steering with the feet allows the operator to paddle instead of sail, since both arms are free to paddle if the mainsheet is released. Under rough conditions, it is advisable to let go of the mainsheet anyway and allow the sail to flap.

The prior patented inventions noted hereinabove both disclose the construction and operation of foot-operated rudders. In USP No. 3,902,441, the rudder configuration involves a rudder permanently connected to the hull that has two engageable blades that fold down to permit flat stowage of the rudder on the hull.

The crux of this patent is to allow stacking of craft one atop another for easy transport and stowage of several craft as might be appropriate in a summer camp. However, such a purpose requires a method of securing the rudder to the deck for transport and is thus unwieldy. The purpose is also not clearly relevant since removable rudders are simple to carry and store. More importantly, the purpose requires giving up too much in terms of simplicity, efficiency and economy of design and setup operation. Thus, the aforesaid rudder configuration is somewhat cumbersome in design, and has proved difficult to produce and difficult to set up for operation. It is also expensive to fabricate since it requires two folding flaps which must be hinged. In addition, a fastening device is necessary to hold the two flaps together.

Secondly, because the footbar forms part of the backboard on which the rudder blades are hinged, the footbar cannot be adjusted. The adjustment of the footbar from the stern of the boat is most important and critical in that because an operator's weight distribution bow to aft is determined by his distance from the contact between his feet and the footbar, and thus his center of gravity's location determines how the sailboat rides in the water. For short operators the stern of the boat tends to drag in the water while the bow sticks up above the water. When the bow rides high out of the water it compromises efficiency and stability.

Thus, the disadvantages of the present configurations involves excessive complexity of design and construction, cumbersomeness in setting-up for operation, as well as the inability to adjust rudder for operator height or length when in the prone position on the sail board.

Another disadvantage of the present configurations deals with the retractable centerboard which is difficult to produce since it requires specific fittings having very precise proportions. Such fittings include the centerboard blade, which can expand or warp and thus stick in the centerboard trunk, as well as controls for retraction of said blade, which can wear and break. In this connection, it should be recognized that the centerboard assemblage adds weight to the craft since a watertight centerboard trunk is required.

Another particular disadvantage of the centerboard which is used in U.S. Pat. No. 3,902,441 is that it does not provide the lateral stability that could be achieved with leeboards, which serve the same purpose. The use of leeboards are particularly helpful in stabilizing sailboards, which are relatively unstable as compared with sailboats. The sailboard in U.S. Pat. No. 3,902,441 is designed with the option of mounting outrigger foils for stability. Although such outriggers are not necessary for operating the craft, they are even less useful if the centerboard is replaced by leeboards. Leeboards, which are a standard feature of many sailboats, are not considered outriggers by the industry.

With reference to U.S. Pat. No. 3,793,973, this patent utilizes a rudder that may appear to partially meet both of the disadvantages of the previously mentioned rudder, but sacrifices several of its advantages, and it partially accomplishes the first objection of complex rudder design by utilizing a single blade rudder with fixed footbar. The disadvantages of this configuration will be discussed below. The second objection, lack of adjustability, is accomplished in this patent by utilizing an adjustable rudder boom that connects at one end to the rudder and at the other end telescopes from a hollow shaft built into the hull of the craft. When the operator wishes to adjust the length of the craft he slides the boom in or out of the shaft and tightens the boom with a clamp.

Of the several disadvantages with this configuration, the method of adjustment is most difficult, and secondly, the hull is necessarily shorter than is preferred for craft stability because one hull size fits all individuals. Short individuals prefer the rudder boom to be adjusted far inward relative to taller people and tall individuals, on the other hand, require that the boom be extended far out from the stern of the hull. For tall individuals the knees tend to drag in the water, reducing efficiency and causing discomfort in cold water. Thirdly, since the configuration requires a short hull to meet its intended purpose, the speed of the craft is seriously reduced and the stability of the craft is compromised. In as much as hull length contributes to velocity and stability, it is for these reasons of stability, etc., that the craft is of necessity equipped with hydrofoil outriggers. Such outriggers slow the boat down further. In addition, the distant rudder with its wide footbar acts as a second hull, slowing the boat down even further.

Another disadvantage of such rudder design is that the materials used in construction must be buoyant. If they are not, the rudder will submerge. Submersion may cause the rudder boom to drag in the water, clog the adjustment holes in the boom with water-borne weeds and debris, and put pressure on the shaft and its watertight casing.

An additional disadvantage of such rudder design is that, unlike the rudder of U.S. Pat. No. 3,902,441, the rudder is not pivotable in a verticle plane. It thus can be damaged or can impede progress when striking submerged objects. Furthermore, such design is a relatively complicated production project, requiring a watertight boom shaft set in the hull.

SUMMARY AND OBJECTS OF THE INVENTION

Accordingly, it is the principal object of the invention to provide an improved adjustable sailboard having a unique and novel rudder that contains very few moving parts, such as folding flaps, fasteners or a telescoping boom, and a rudder that is relatively easy to produce with common materials that need not be buoyant.

Another object of the invention is to provide an adjustable sailboard which is easy to understand, easy to set up for operation and easy to adjust for leg length.

Yet a further object of the invention is to provide a rudder for a sailboard that is adjustable in a way that does not interfere with the many advantages of a full-length hull, including velocity and stability enhancement.

It is also yet another object of the invention that the novel rudder can be used on hulls of different lengths such that children can utilize it on a much smaller sailboard hull as compared to hulls for adults.

A still further object of the invention is that the novel rudder does not slow the craft down by acting as a second hull or dragging object by virtue of its distance from the hull.

Yet another object of the invention is that the novel rudder pivots in two orthogonal planes allowing for passage over submerged objects.

It is another object of the rudder invention to provide a novel rudder that can be easily attached and detached from the hull and one that does not need to be stowed as an integral part of the hull, so that removal from the hull permits easy rolling, lifting or otherwise maneuvering the sailboard on land without having to secure the rudder to the deck.

A further object of the invention is to provide an adjustable sailboard with leeboards of simple design and operation, thereby allowing for greater portability.

It is another object that the leeboards be less prone to jamming or other failures as compared to centerboard configuration of the aforesaid U.S. Patent to Roger A. Scholle.

It is a further object that the leeboards provide lateral stabilization of the craft relative to a centerboard, and thus eliminate the need for outriggers, which are cumbersome and slow the boat down.

It is an object of the invention to provide an adjustable sailboard with wheels to provide easy transportability over land while being so situated as to be out of the way of the hull as it rests on land and so as to be nonobstructive and nonresistant to hydrodynamics of the hull under sailing conditions.

It is yet a further object of the inventions that the wheels be permanently attached to the craft and thus need not be set up each time the craft is to be used, in contrast to conventional detachable wheels for moving a hull on land.

DESCRIPTION OF THE DRAWINGS

FIGS. 10A, 10B and 10C show another alternate rudder embodiment wherein the means for attaching and adjusting the footbar to the rudder is by means of a "V" or "U"-shaped slot and pin arrangement.

DESCRIPTION OF THE PREFERRED EMBODIMENT

Figure 1:
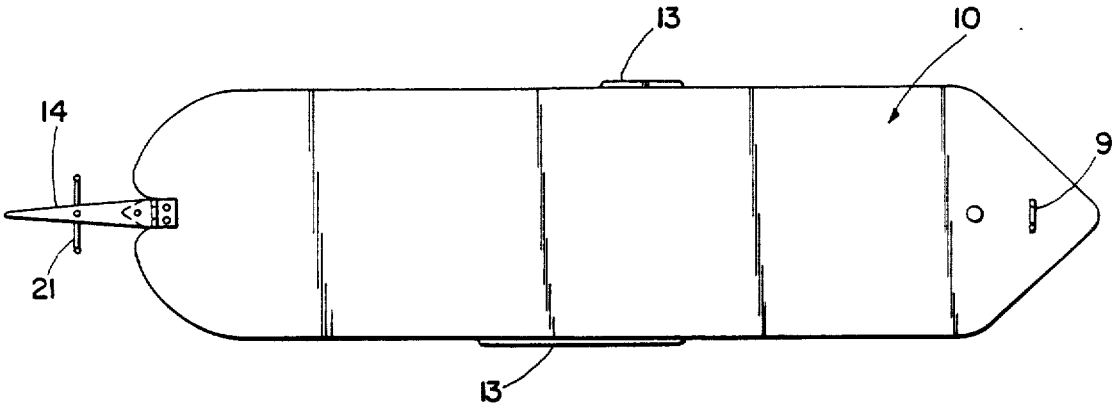
FIG. 1 is a top plan view of the adjustable sailboard of our invention.

Referring now to the drawings, and in particular to FIGS. 1–4, a novel rudder of the invention is shown connected to an adjustable sailboard 10 having a hull 11 with a semicircular notch 11*a* cut vertically into the stern thereof and being of slightly greater radius than the forward edge of the rudder 14. The adjustable sailboard further comprises a mast 12, pivotable leeboards 13, and a pair of stern assemblies 24. Above the notch 11*a* is a suitable strap hinge 16 with permanent pin 16*a* and unequal-length leaves. The long leaf is fastened to the deck 15 of the craft, and the short leaf 16*b* protrudes rearward of the stern. The short leaf 16*b* is inserted into a horizontal slot 17 at upper front edge of the rudder 14. The hinge leaf 16*b* is also provided with an aperture 18*a*. A vertical hole 18 descends from the top front edge of the rudder 14, and passes through the horizontal slot 17 and ends blind within the body of the rudder. Pivot pin 19 passes through holes 18 and 18*a* and is suitably retained in place so that the rudder pivots freely in a horizontal plane around the pin 19.

Thus, with pivot lines or pins 16*a* and 19, the rudder swivels in planes orthogonal to one another. The removable pivot pin 19 permits the rudder to pivot freely in a horizontal plane and thus allows the steering of the craft, while the permanent, horizontal pin 16*a* of the hinge 16 permits the rudder to pivot vertically so that it can pass over submerged objects.

Removable pin 19 also allows the rudder to be removed from the craft, making the craft lighter for lifting and permitting easy rolling or otherwise maneuvering of the craft on land without having to secure the rudder to the deck.

The footbar 21 passes perpendicularly through the rudder and is made about half-inch or more in diameter, of a corrosion-proof material and need not be buoyant. The footbar can be of other shapes in cross section such as oval, square, rectangular or polygonal so long as the foot bar is strong and can cooperatively associate with appropriate apertures suitably provided in the rudder 14. The footbar 21 can also be specially shaped, notched or indented in the center or otherwise along its length to fit into an aperture for secure attachment to the rudder. Rubber or "dipped" plastic crutch-tip-type caps 21*a* may be provided as protective padding at the ends of the foot bar 21. Such caps 21*a* may be permanently attached or removable from the ends of the footbar when transferring the footbar from one to another of the series of "adjustment" holes 22.

Operation of footbar 21 is such that when operator is lying in a prone position on the deck 15 with head toward the bow and feet pressing on the footbar, the left foot pressing on the left side of the footbar will turn the rudder to the right, causing the craft to turn right, and the right foot pressing on the right side of the footbar will cause the opposite effect.

Figure 4:
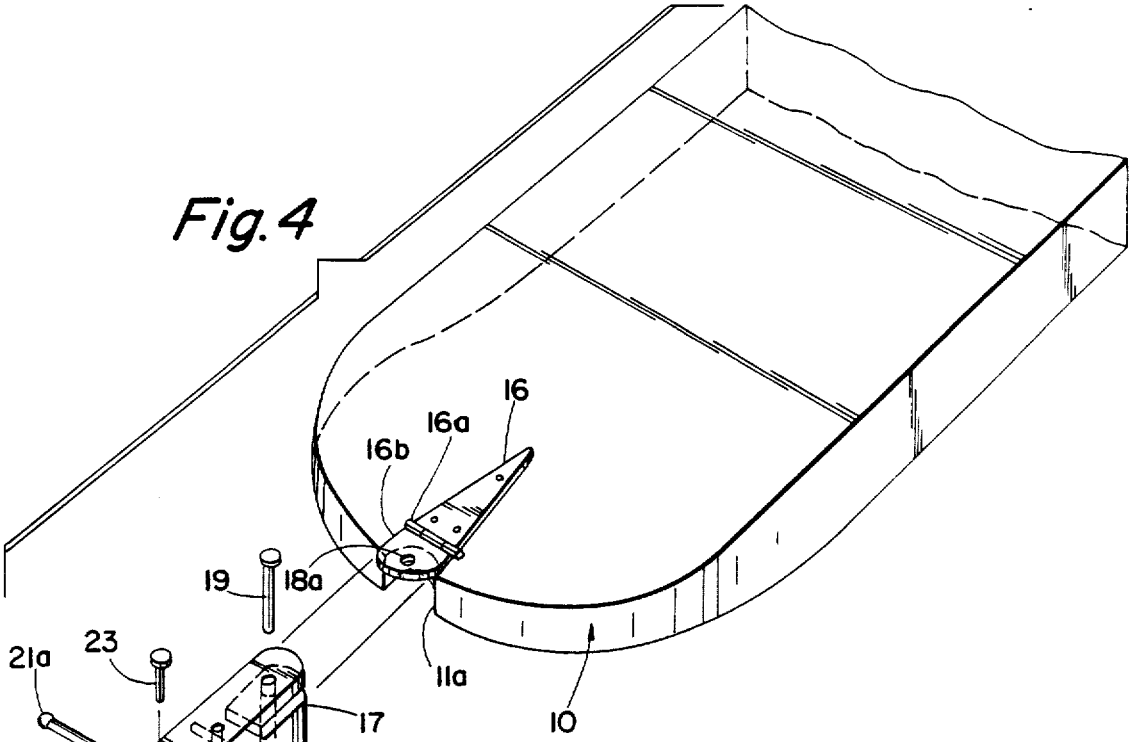
FIG. 4 is an enlarged exploded view in perspective, of the stern portion of the sailboard with protruding hinge and adjustable rudder with connecting hardware.

As best shown in FIG. 4, the preferred rudder arrangement for adjusting and locking of the footbar 21 is shown with a rudder blade 14 having a multiplicity of horizontal holes or notches 22 situated along the upper edge of the rudder 14. A footbar 21 passes through any of said holes, and is shown for purposes of illustration only of being inserted in the middle hole 22. A pin, screw or other object 23 descends through vertical hole 20 descending from the top edge of the rudder 14 and through a vertical hole (not shown) in the footbar 21 and ends blind in the body of the rudder 14.

With this rudder arrangement, the holes 22 situated horizontally along the upper edge of the rudder 14 facilitate the adjustment of the footbar 21 to the length of a sailor's legs. Adjustment involves moving the footbar 21 from one hole 22 to another. Permanent or removable rubber or plastic crutch tips or caps 21*a* at the ends of the footbar 21 may be used to protect one's feet from injury, and may be designed to slide or screw off and onto the ends of the footbar 21 when moving the footbar from one to another of holes 22. The footbar 21 is locked into place by pin 23 so as to prevent it from any lateral shift.

Figure 5:
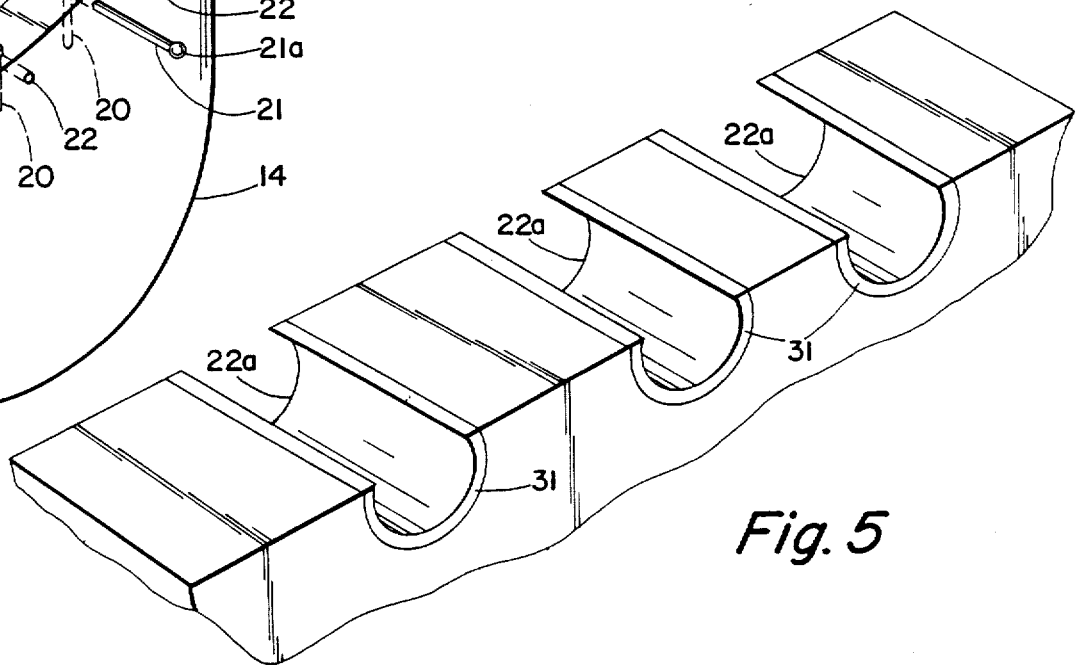
FIGS. 5 and 5A are fragmentary views, showing an alternate rudder embodiment wherein the means for adjusting and attaching the footbar to the rudder is by means of a gripping clamp-like arrangement.
Figure 5A:
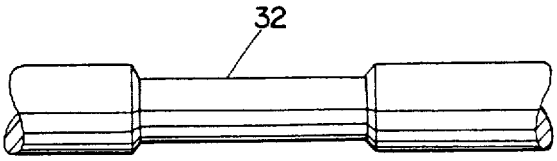

In the embodiment of FIGS. 5 and 5A, the apertures are notches 22*a* with a resilient neoprene or other pressure responsive material 6 which is also capable of frictionally gripping the footbar 21 about a collar zone 7 located centrally in the footbar 21.

Operation of the above-described embodiments involves either pulling footbar 21 out of one of the holes or notches 22*a* or pushing and/or snapping same into another notch.

Figure 6A:
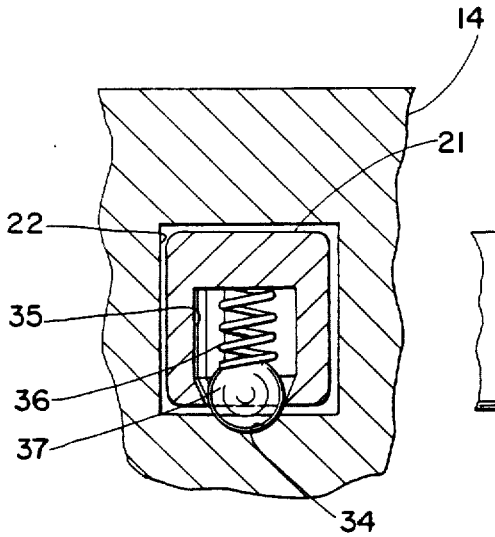
FIGS. 6, 6A, 6B, and 6C show another alternate rudder embodiment wherein the means for adjusting and attaching the footbar to the rudder is by means of a detent mechanism.
Figure 6:
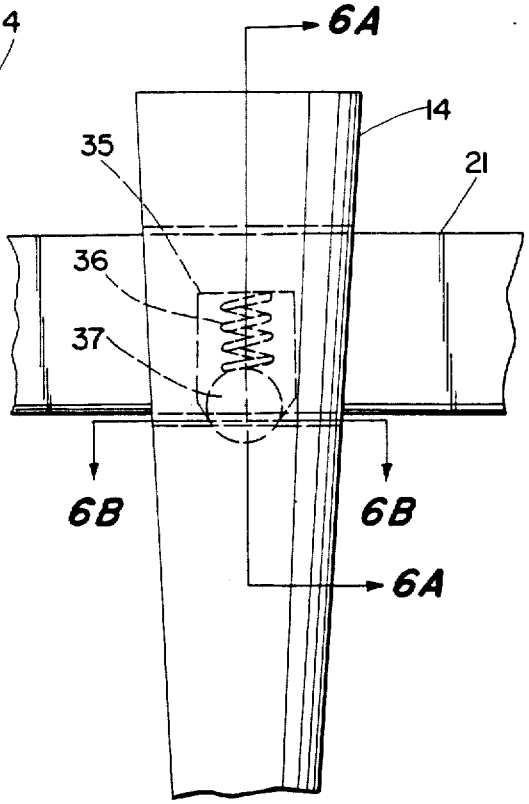
Figure 6B:
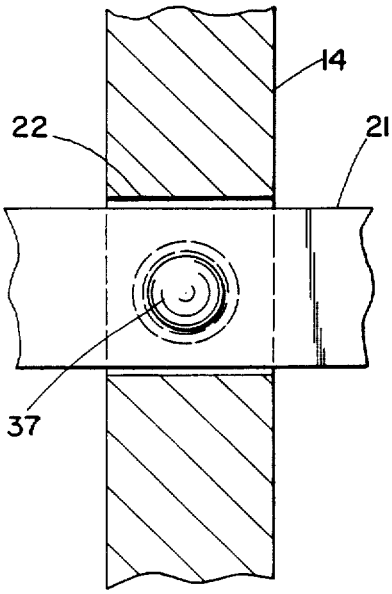
Figure 6C:
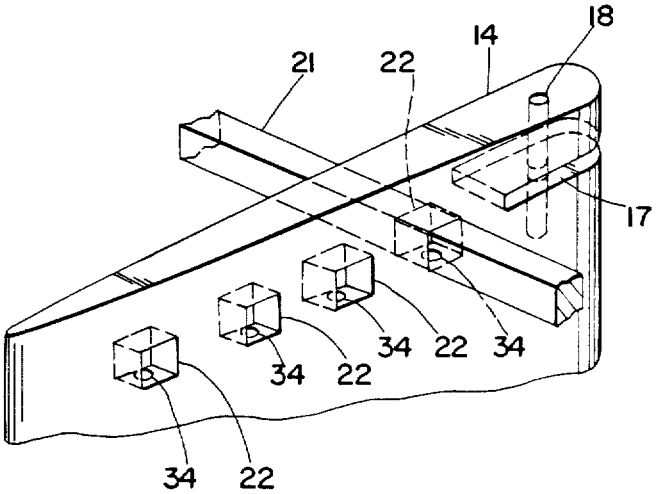

FIGS. 6, 6C further shows an embodiment wherein a catching detent-type mechanism 35 having a spring-loaded ball 36, 37, respectively, set in the footbar and with a corresponding detent 34 in the holes 22. FIGS. 6, 6A, 6B and 6C further show other views of the ball/detent mechanism 35, as situated in the footbar 21 and relative to the rudder 14. In operation, the footbar 21 is snap-locked into place so that detent 34 catches ball 37, thereby retaining the footbar 21 in place when assembled to the rudder 14.

Figure 7A:
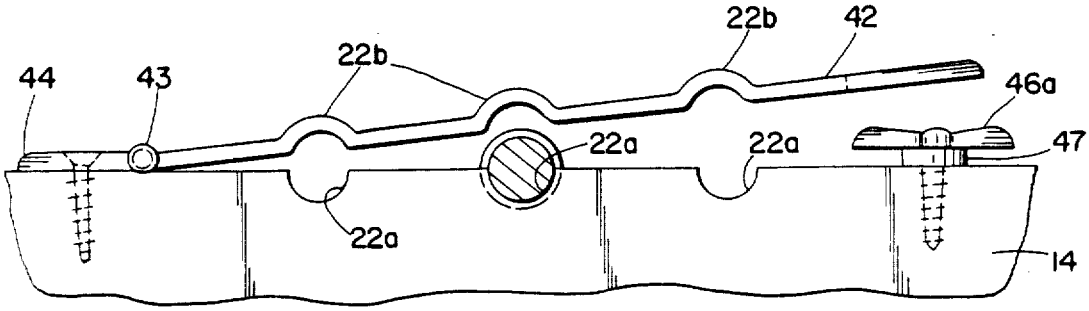
FIGS. 7A and 7B, illustrate a further alternate rudder embodiment wherein the means for adjusting and attaching the footbar to the rudder is by means of a hinged strap.
Figure 7B:
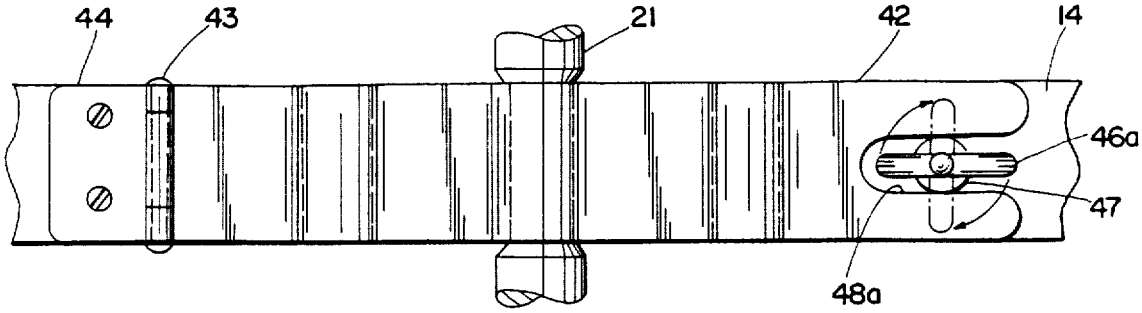

FIGS. 7A and 7B illustrate a strap 42 attached by a pin 43 to a stable plate 44. The plate 44 is attached to the rudder 14. Stamped notches 22*b* align with notches 22*a* in the rudder 14 when the strap 42 is closed and rests atop the rudder 14. A locking mechanism 46*a* is joined to rudder 14 by a mounting fastener 47. Locking mechanism 46*a* swivels inside end notch 48*a* of strap 42. Footbar 21 is indented at 21*a* where it meets notch 22*a*.

Alternatively, a series of short straps (not shown) one placed over each aperture in the rudder, secured by individual pivoting means and individually locked by similar means as above may also be used to practice the invention.

Figure 8A:
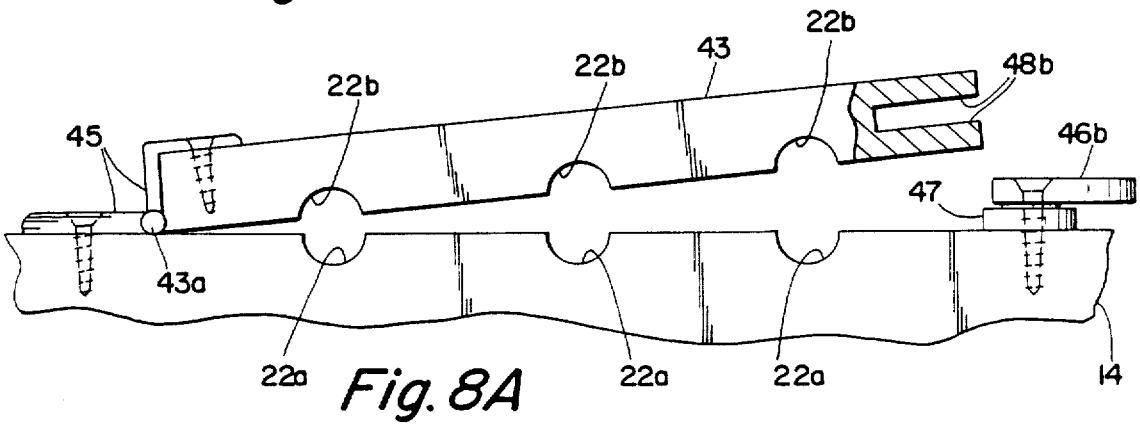
FIGS. 8A and 8B show an alternate rudder embodiment wherein the means for attaching and adjusting the footbar to the rudder is by means of a split hinge.
Figure 8B:
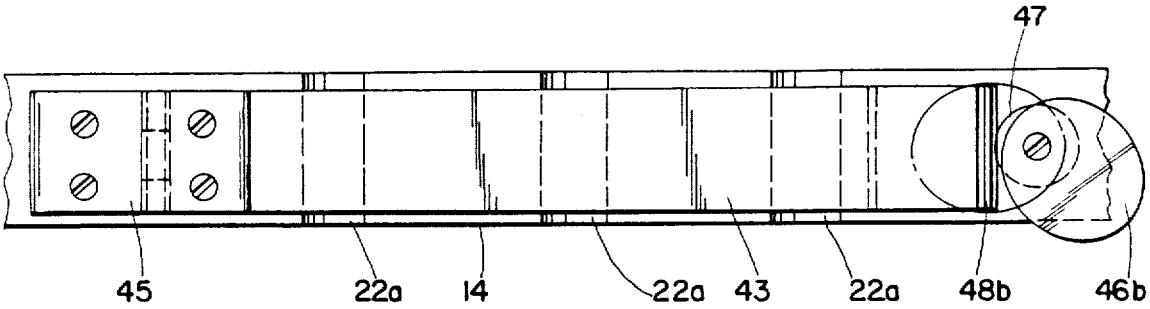

FIGS. 8A and 8B show a split hinge-like arrangement similar to the strap arrangement in FIGS. 7A and 7B. Strap 43 is connected to the rudder 14 by a hinge 45, and locking mechanism 46*b* swivels into end slot 48*b*.

In operation, the embodiments in FIG. 8 basically function like that of FIGS. 7A and 7B, and involve securing the footbar in notches 22*a* by closing and locking a member or strap 43 over the slots 22*a* in the upper edge of the rudder 14. The strap 43 is permanently attached at one end 45 to the top of the rudder 14. The strap 43 pivots up and down by means of a permanent pivot pin 43*a* set into the joint between the attached hinge end 45 and the movable leaf of the hinge which is attached to the strap 43. The strap 43 is provided with cut or stamped tunnels or notches 22*b* that match the notches 22*a* on the upper edge of the rudder 14 to form complete holes when the strap 43 is closed against the rudder top. Thus, the apertures would function as unitary holes such as those identified by numerals 22 in FIG. 3, but would open to allow the footbar to be moved. Notches 22*b* in strap need not be semicircular in form, but may be shaped asymmetrically relative to notches 22*a* in the rudder, such that a footbar with compatible shape where it meets notch 22*b* is wedged by the closing of the notches 22*b* over the footbar.

The strap 43 may be further secured at the opening end by various means, such as by a thumb screw or pivoting knob 46*a* fitting over a slot 48*a* in the end of the strap 42, or by an asymmetrical pivoting knob 46*b* fitting in an end slot 48b. Other arrangements may be employed, such as a spring-operated hold down bolt or a switchable slide bolt, clasp, snap, or even Velcro-type fastener. The important aspects of the locking device is that it is simple to operate and is secure against accidental opening.

Figure 9A:
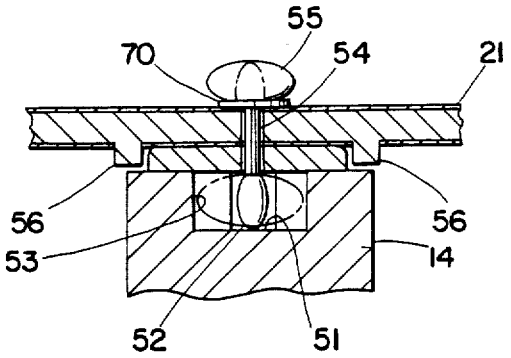
FIGS. 9A, 9A', 9B and 9B' show yet another alternate rudder embodiment wherein the means for adjusting and attaching the footbar to the rudder is by means of a key and slot arrangement.
Figure 9A:
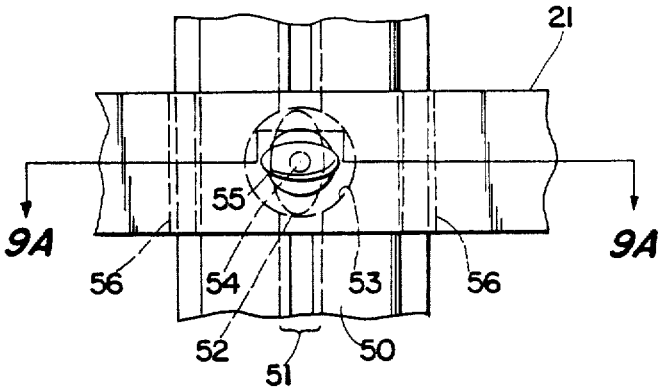
Figure 9B:
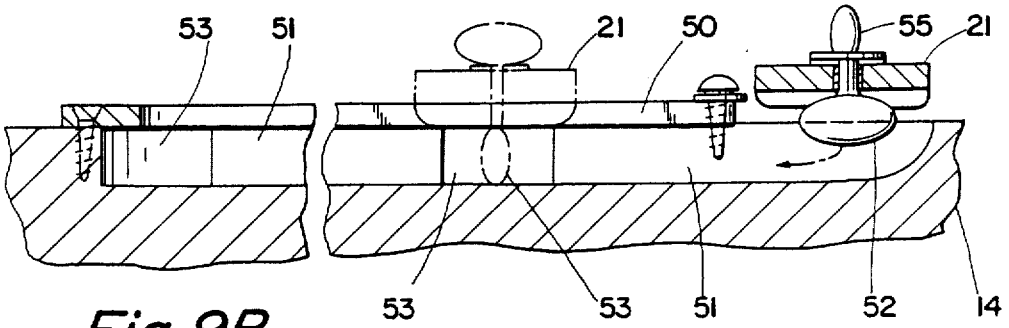
Figure 9B:
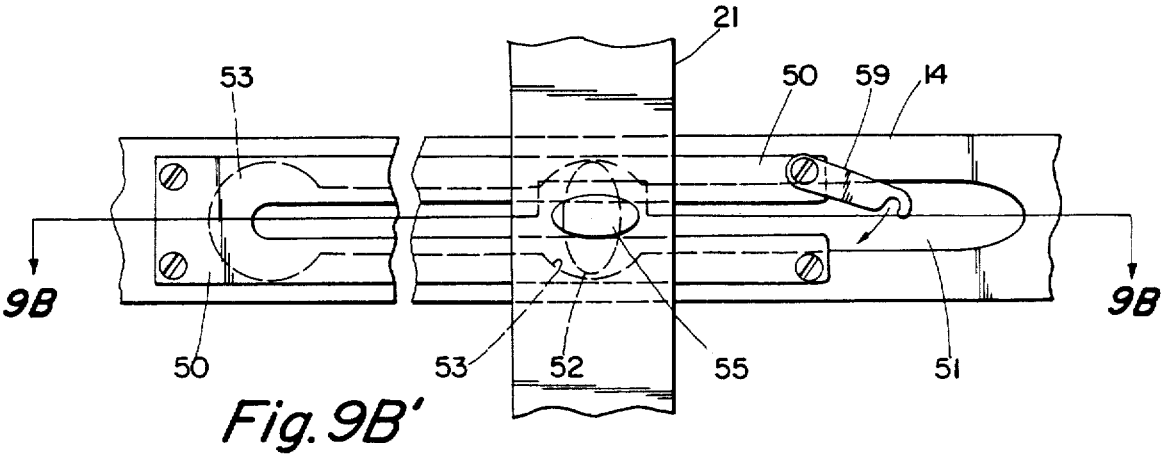

FIGS. 9A, 9A', 9B, and 9B' illustrate a modified rudder embodiment with a slot 51 formed longitudinally in the upper edge of the rudder 14. A slotted, preferably metal plate 50 covers the slot 51 either for its full length or leaving space at the forward end of the slot 51. In the latter case, a hook or gate device 59 pivots and locks the forward end of the slot 51 in plate 50. A runner-and-key device 52 descends through the footbar 21 and slides inside the slot 51. The runner-and-key device 52 is longer along its longitudinal dimension than its lateral dimension and/ or is asymmetrical along one of its longitudinal edges. Slot 51 is notched at regular intervals 53 in a shape generally cooperative with the longitudinal edges of the key device 52. Runner-and-key device 52 is immovably attached to a pin or stalk 54 which passes freely through the footbar 21 and is suitably crowned by a knob, wingnut, or other suitable and manipulable or gripable hardware 55. Pin or stalk 54 may optionally be higher than the thickness of the footbar 21 and notches 53 ma also be deeper than the slot 51. The rectangular blocks 56 attached to and descending from the footbar 21 sandwich the top edge of rudder 14 or sides of the metal plate 50. Alternatively, the plate 50 may have a slot shaped in an inverted "T", triangle, cylinder, etc. with a reciprocallyshaped key device fitted into said alternative-shaped slot. A suitable spring washer 70 retains the key runner-and-key device 52 in position in any one of the notches 53.

In operation, the runner-and-key device 52 is connected to the footbar 21 so that the footbar 21 can slide fore to aft along the rudder top. Securing the footbar 21 involves connecting said runner/key device 52 to a vertical pin 54 that projects through holes in the bottom and top of the footbar 21 at its center. The pin 54 has a knob, wingnut or other gripping device 55 connected to its top; and the runner-and-key device 52 fits into one of several keyhole notches 53 placed in the slot 51 by rotating and/or plunging the runner/key by means of the knob 55. Asymmetrical or oblong shape also, the runner/key device allows for a non-slip fit into the keyhole. Also, the rectangular blocks 56 enable footbar 21 to maintain perpendicular aspect relative to rudder when under foot pressure.

Figure 10A:
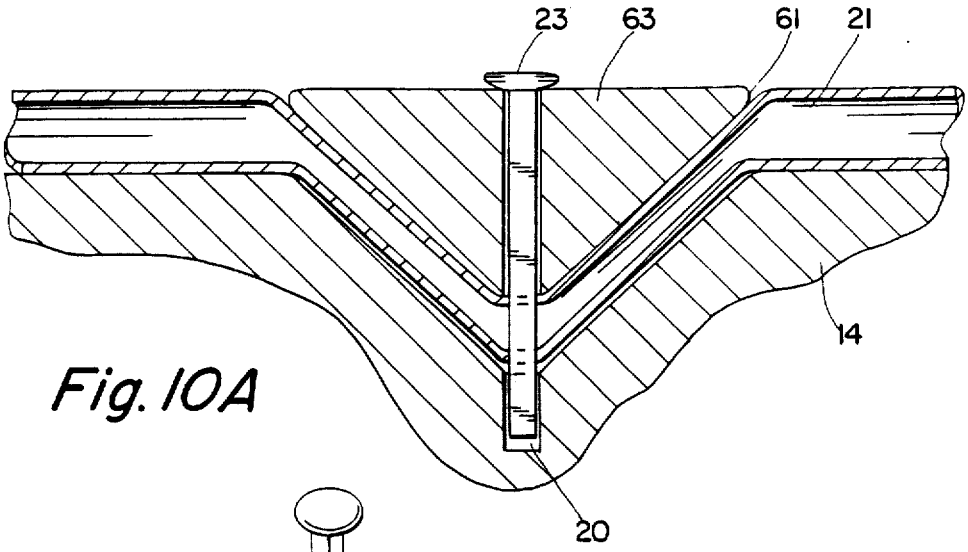
Figure 10B:
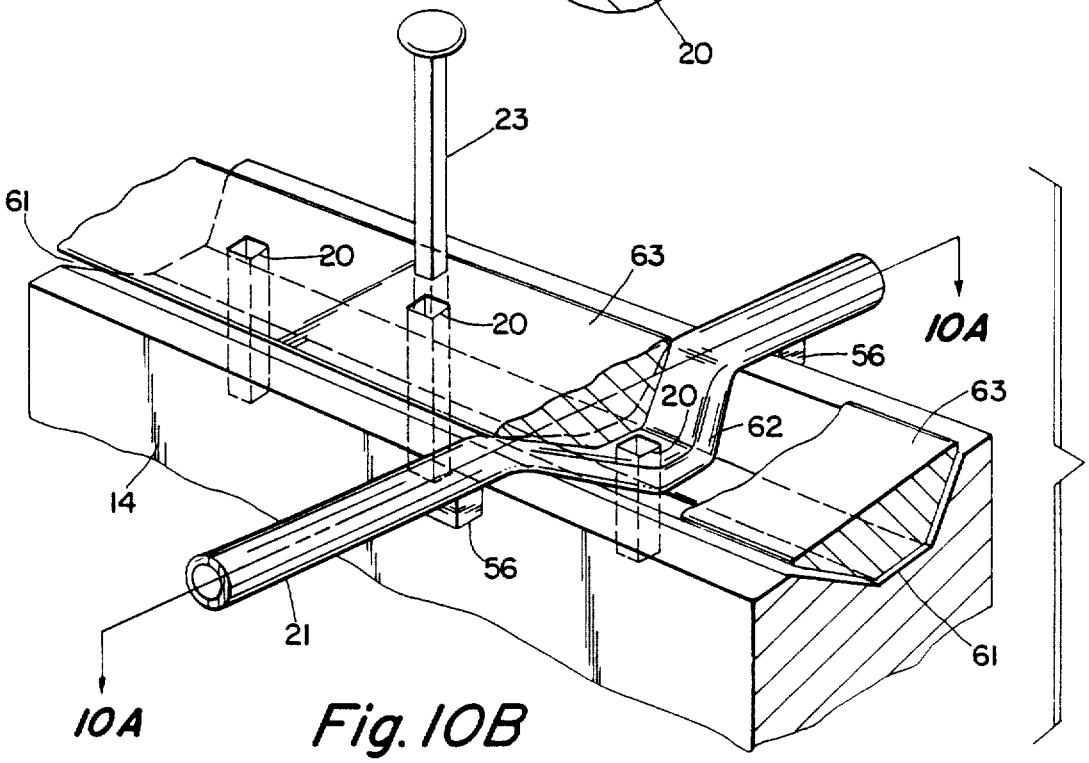
Figure 10A:
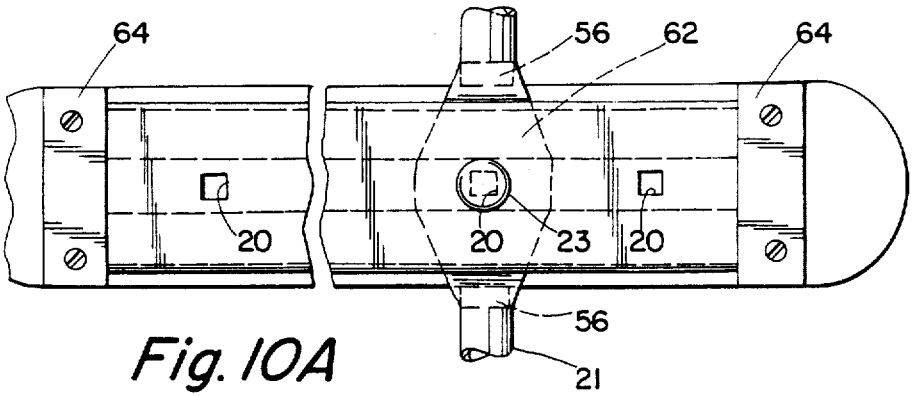

FIGS. 10A, 10B and 10C depict a "V" or "U"-shaped slot 61 running longitudinally along the upper edge of rudder 14. Reciprocally sized and shaped "V" or "U" 62 is found in center of footbar 21. Footbar is flat horizontally along said shape 62. Shape 62 in footbar is sandwiched from above by reciprocally shaped bar 63 suspended between blocks 64 at ends of rudder 14. Rectangular blocks 66 attached and descending from footbar 21 sandwich top edge of rudder 14 and still allow footbar 21 to slide. Vertical holes 68 descending through top of bar 63, slot 61 end in blind holes within body of the rudder 14. Such holes 20 also pass through the shaped section 62 of footbar 21. Removable pin 23 fits snugly into said holes 20. In operation, the footbar 21 travels fore and aft in a "V" or "U"-shaped slot in the top edge of rudder 14. The footbar 21 rides between said slot and solid "V" or "U"-shape strip covering and seated in the angled shape 62 formed in the footbar 21. Holes 20 passing vertically through the bar 63, footbar 21 and ending blind in the rudder 14 receive a pin or other means for securing the footbar 21 in longitudinal axis. Blocks 56 prevent the footbar 21 from turning on a lateral axis when a foot presses against one side of bar or the other, while allowing enough slippage with the rudder surface to permit the footbar to slide when being adjusted to a sailboard user. In an alternate construction, pin 23 and holes 20 may be square or otherwise polygonal and thus also preclude footbar 21 form turning on a lateral axis.

Other means of securing the footbar which were shown and described in some of the alternative embodiments include securing the runner in the slot using a detent mechanism, a spring catch or a track mechanism, with a horizontal pin-and-hole arrangement, or by means outside of the runner-and-slot assembly, such as a strap or pin arrangement between the footbar and the rudder.

Figure 2:
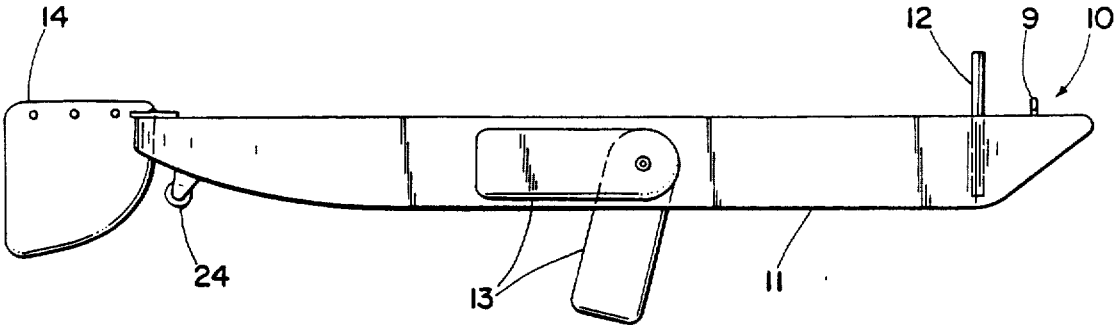
FIG. 2 is a side elevational view of the sailboard of FIG. 1, showing a leeboard, rudder and wheel assembly.
Figure 3:
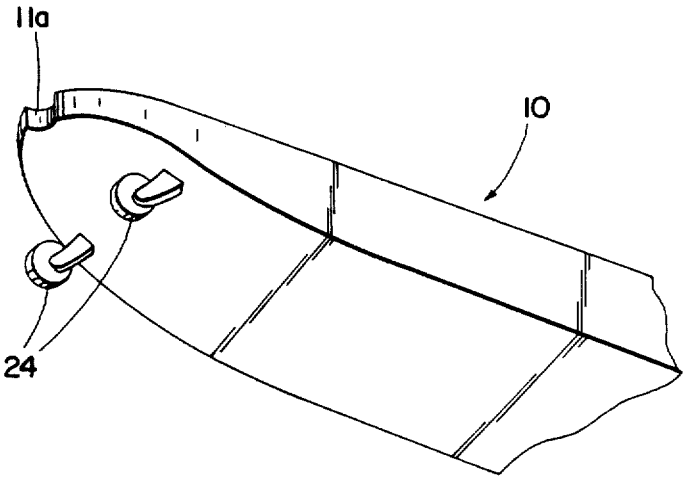
FIG. 3 is a fragmentary perspective view of the underside of the rear portion of the hull, illustrating both wheel assemblies.

As best shown in FIGS. 2 and 3, wheel assemblies or casters 24 are permanently attached to the buttocks of the hull, approximately 4/5 of the length rearward of the bow, far enough aft so that the wheels clear the ground when the craft is lying on its bottom on shore, and separated enough from side to side so that the hull will balance when lifted from the bow and rolled.

The wheels 24 are operational when the craft is lifted by a handle 9 at the bow of the craft 10 and pulled along the ground. The wheels 24 thus permit the craft to be rolled. The placement of the wheels is such that they do not lie beneath the hull bottom when the craft is lying flat on land.

As best shown in FIGS. 1 and 2, leeboards 13 swivel around fixed bolts 13a protruding laterally from each side of the hull of the sailboard 10. The leeboards are suitably secured with the use of wing nuts, washers, rubber gaskets, or quick-release-type levers, or other spring-loaded levers which are hand-operated and permit the ready adjustment of tightness of the leeboards to the hull. The leeboards 13 swivel from a stowed horizontal position along the hull to an activated verticle position in the water. The handoperated means permit set-up and take down adjustment as well as tightness of swivel action. Leeboards operate by pressing them down to a vertical position in the water. When running before the wind leeboards cause drag, and thus they are made to be retracted as desired by the sailor by pulling them up to the horizontal position.

The invention has been described in terms of specific embodiments set forth in detail herein, but it should be understood that these are by way of illustration and the invention is not necessarily limited thereto. Modifications and variations will be apparent from the disclosure and may be resorted to without departing from the spirit of the invention as those of skill in the art will readily understand. Accordingly, such variations and modifications are considered to be within the purview and scope of the invention and the following claims.

What is claimed is:

1. An adjustable sailboard comprising a hull, deck, mast and sail assembly and a foot-operated rudder, said rudder extending from the stern of said sailboard and being rotatably mounted about a vertical axis, said rudder further including an adjustable footbar removably mounted transverse to said rudder so as to accommodate sailboard users of different height and maintain a desired craft displacement when in use, said sailboard further including means mounting said footbar to said rudder for adjustment thereof along the rudder length.

2. The adjustable sailboard according to claim 1, wherein said mounting means for said footbar comprises a plurality of parallel apertures along the top of said rudder, and pin means extending through said footbar mounted in said aperture and partially through said rudder for fixedly positioning said footbar in place along the length of said rudder.

3. The adjustable sailboard according to claim 1, wherein said mounting means for said footbar comprises a plurality of parallel apertures along the top of said rudder, and spring-loaded ball detent means in said footbar for engagement with a cooperatively associated detent means in said aperture having mounted therein said footbar.

4. The adjustable sailboard according to claim 1, wherein said mounting means for said footbar comprises a plurality of notches along the top of said rudder, and said footbar being mounted in said notch, whereby said footbar is fixedly positioned in place along the length of said rudder.

5. The adjustable sailboard according to claim 4, including wherein said footbar includes a necked-down portion sized to mate with said notches to preclude transverse footbar movement.

6. The adjustable sailboard according to claim 4, including a rigid hinged strap pivotally mounted to the top of said rudder and extending over said notches, and said strap further being held in a gripping position by locking means at the free end thereof.

7. The adjustable footbar according to claim 6, wherein said hinge strap is provided with compatibly-shaped notches for gripping said footbar in any notch position.

8. The adjustable sailboard according to claim 4, further including resilient means disposed between said footbar and said notches.

9. The adjustable sailboard according to claim 1, wherein said mounting means for said footbar comprises a trough along the top of said rudder, said footbar having a compatibly-shaped center position for mating with said trough, and a compatibly-shaped hold-down element mounted to the top of said rudder gripping said footbar.

10. The adjustable sailboard according to claim 9, wherein said footbar further includes stops extending on either side of said rudder for precluding transverse and pivotal movement of said footbar.

11. The adjustable sailboard according to claim 9, further including pin means extending through an aperture presented in said footbar and compatible apertures in said hold-down element and said rudder.

12. The adjustable sailboard according to claim 11, wherein said pin means is polygonal, with said apertures being compatibly shaped in cross section for precluding transverse and pivotal movement of said footbar.

13. The adjustable sailboard according to claim 1, wherein said mounting means for said footbar comprises a channel-like slot along the top of said rudder with a plurality of keyhole-like notches spaced therealong, and with a slotted cover plate aligned and secured to said rudder; said footbar further including a mating keyhole device rotatably secured thereto and adapted to be mated in place with any of said keyhole-like notches when rotated in said channel-like slot, whereby said footbar is moveable along the length of said rudder and retained in desired positions when said keyhole device is positioned in anyone of said keyhole-like notches.

14. The adjustable sailboard according to claim 13, wherein said footbar further includes stops extending on either side of said rudder for precluding transverse and pivotable movement of said footbar.

15. The adjustable sailboard according to claim 1, further including a leeboard on either side of said hull, and said leeboards being pivotably mounted to said hull so as to be raised and lowered as desired.

16. The adjustable sailboard according to claim 1, wherein at least one wheel assembly is provided on the underside of said hull in the stern area for facilitating the handling of said hull on land.

17. The adjustable sailboard according to claim 16, including a pair of wheel assemblies spaced apart from each other.

18. A sailboard comprising a hull, deck, mast and sail assembly and a foot-operated rudder, said rudder extending from the stern of said sailboard and being rotatably mounted about a vertical axis, said rudder further including a footbar mounted transverse to said rudder, said sailboard being provided with rotatable means for connecting said rudder to the stern of said sailboard whereby said rudder is rotatably mounted in a direction generally orthogonal to said vertical axis, and where said rotatable means is a hinge made of hinge leaves, one of said leaves having an aperture and said leaf having said aperture being connected to said rudder by means of a removable pin forming said vertical axis and passing through said aperture and mating apertures in opposing rudder sections separated by slot means for the passage of said apertured leaf, whereby said rudder is removable.

19. The adjustable sailboard according to claim 18, wherein at least one wheel assembly is provided on the underside of said hull in the stern area for facilitating the handling of said hull on land.

20. An adjustable sailboard comprising a hull, deck, mast and sail assembly and a foot-operated rudder, said rudder extending from the stern of said sailboard and being rotatably mounted about a vertical axis, said rudder further including an adjustable footbar removably mounted transverse to said rudder so as to accomodate sailboard users of different height and maintain a desired craft displacement when in use, said sailboard being provided with rotatable means for connecting said rudder to the stern of said sailboard whereby said rudder is rotatably mounted in a direction generally orthogonal to said vertical axis, and where said rotatable means is a hinge made of hinge leaves, one of said leaves having an aperture and said leaf having said aperture being connected to said rudder by means of a removable pin forming said vertical axis and passing through said aperture and mating apertures in opposing rudder sections separated by slot means for the passage of said apertured leaf, whereby said rudder is removable.

* * * * *